US005636767A

United States Patent [19]

Vogrin

[11] Patent Number: 5,636,767

[45] Date of Patent: Jun. 10, 1997

[54] EASY DISPENSING BOTTLE FOR VISCOUS LIQUIDS

[76] Inventor: Keith J. Vogrin, 2072 Ninth St., Bethlehem, Pa. 18017

[21] Appl. No.: 225,187

[22] Filed: Apr. 8, 1994

[51] Int. Cl.[6] ..... B67D 5/06

[52] U.S. Cl. ..... 222/185.1; 222/481; 222/534

[58] Field of Search ..... 222/173, 179.5, 222/184, 185, 212, 215, 481, 482, 478, 479, 531, 533–536, 185.1

[56] References Cited

U.S. PATENT DOCUMENTS

| | | | |
|---|---|---|---|
| 1,832,798 | 11/1931 | Taylor | 222/481 X |
| 2,543,163 | 2/1951 | Greiner | 222/481 |
| 2,800,259 | 7/1957 | Wilson et al. | 222/534 |
| 2,942,760 | 6/1960 | Schneider | 222/531 X |
| 3,142,935 | 8/1964 | Campos | 222/481 X |
| 3,342,379 | 9/1967 | Foley | 222/173 |
| 4,066,080 | 1/1978 | Sneider | 222/481 UX |
| 4,420,101 | 12/1983 | O'Neill . | |
| 4,428,507 | 1/1984 | Sneider | 222/184 X |
| 4,898,306 | 2/1990 | Pardes | 222/215 X |
| 5,037,005 | 8/1991 | Appleby et al. | 222/184 |
| 5,141,136 | 8/1992 | Tignor . | |
| 5,186,346 | 2/1993 | Calvert . | |
| 5,284,264 | 2/1994 | Gross | 222/534 X |
| 5,370,277 | 12/1994 | Wallis | 222/534 X |
| 5,421,488 | 6/1995 | Ehrbar | 222/185.1 |

*Primary Examiner*—Kevin P. Shaver
*Attorney, Agent, or Firm*—Charles A. Wilkinson

[57] ABSTRACT

A container in the form of a bottle is especially designed to quickly dispense viscous liquids such as shampoo, conditioner or suntan lotion without waiting for drainage of the contents toward the dispensing valve or outlet. The bottle has an air inlet at the top and a liquid dispensing valve at one corner of the bottom. The bottom is preferably slanted toward the dispensing valve and the entire bottle is preferably in the form of a three-sided pyramid. When the bottle is used the air inlet cap at the top of the bottle is pulled up allowing air to enter the bottle through air inlet holes just under the air inlet cap to eliminate any vacuum lock effect upon the liquid inside the bottle. The dispensing valve at the bottom of the bottle is then pressed allowing the fluid to flow out into the hand of the user. The user never need wait for the fluid to reach the dispensing valve because it will be able to flow immediately out of the container once the dispensing valve is pressed. None of the contents will be wasted because the contents would always be at the dispensing valve.

22 Claims, 7 Drawing Sheets

EASY DISPENSING BOTTLE FOR VISCOUS LIQUIDS

BACKGROUND OF THE INVENTION (1) Field of the Invention.

This invention relates to containers for liquids and particularly containers for viscous, difficult to pour liquids and more particularly to bottle-type containers suitable for quick dispensing viscous liquids.

(2) Discussion of the Prior Art.

Glass bottles have been used for the storage and dispensing of both easily flowable and viscous liquids for many years, while plastic squeeze bottles have also been used for a considerable time for dispensing viscous-type liquids. Such bottles may be supplied with the usual screw-type cap, which is removed when liquid is to be dispensed, or may have some other type of closure, including automatic valves which open upon an increase in internal pressure. While these various containers have worked efficiently for viscous liquids when the container is full, as the contents of the container are used it takes longer and longer for such viscous liquid to reach the opening, or valve, in the container, so the liquid can be dispensed. This is because the opening in the container is usually at the top in order to keep the contents away from the closure means, whether in the form of a cap or a valve, in order to decrease the possibility of leakage of liquid during non-use. It is thus necessary to invert the bottle or container and allow the liquid to move or drain to the area of the valve or other closure before the liquid can be dispensed from the container. Such internal drainage can take a significant period even in the case of a plastic squeeze bottle, particularly as the bottle becomes progressively more empty. In our current high paced society the necessity to wait for such drainage to occur before dispensing from a container can take, or seem to take, a significant and frequently frustrating amount of time. For example, in the case of shampoo, the majority of users today apply the shampoo in a shower, which shower is frequently used in the first place because of its quicker or more expeditious cleansing, particularly for those who shower in the morning before leaving for work. To wait for shampoo liquid to drain to the lowest portion of an inverted bottle, therefore, can become quite frustrating and tension inducing for the user. Likewise to wait for ketchup or the like to drain to the lowest portion of a inverted bottle can be frustrating to those accustomed to the instant gratification of their wants and needs, at least with respect to fairly inexpensive items.

It has been suggested in the past that the availability and expeditiousness of dispensing of viscous liquids in particular could be considerably expedited if the liquid were kept more or less continuously adjacent to the dispensing closure. Two principle arrangements for effecting this have been tried or developed. In the first of these, an internal membrane is provided to continuously decrease the size of the containment space within the container as the contents of such container are used. Frequently these internal membranes have taken the form of a soft plastic container or the like provided within an exterior hard container plus a means for providing pressure between the two to keep the internal container membrane constantly biased to provide a smaller and smaller internal containment area as the contents of the container are decreased or used. Examples of such arrangements may be found in the following U.S. patents:

U.S. Pat. No. 4,865,224 to D. A. Streck

U.S. Pat. No. 5,012,956 to W. R. Stoody

The second principle manner for decreasing the time necessary for viscous liquid material to reach the dispensing orifice of a bottle or other dispenser is simply to have the dispensing orifice located at or near the bottom of the container where gravity maintains the liquid to be dispensed always adjacent to such dispensing orifice. The principle difficulty with this arrangement is that the valve at the orifice is likely to leak and either a separate back-up valve must be used or a more complicated combined vent and dispensing orifice valve used at the bottom. Examples of this type of arrangement are shown in the following U.S. Patents:

U.S. Pat. No. 4,420,101 to R. K. O'Neill

U.S. Pat. No. 5,037,005 to P. Appleby et al.

U.S. Pat. No. 5,141,136 to J. H. Tignor

U.S. Pat. No. 5,186,346 to J. H. Calvert

The Tignor U.S. Pat. No. 5,141,136 also combines a flexible side wall with an opening at the bottom and the Calvert U.S. Pat. No. 5,186,346 incorporates an opening which is at the bottom of the container only part of the time.

A further type of quick dispenser uses a so-called dip-tube in the bottle or container the entrance to which dip-tube is always located near the bottom of the container so that the opening to the tube is always in or immediately adjacent to the liquid material. An example of this is disclosed in U.S. Pat. No. 5,127,553 to J. Weinstein. Dip tubes must be combined with some form of pressure or pumping arrangement and are usually not too effective with viscous liquids because the dip tube almost inherently has a rather restricted inner diameter which may offer a significant impediment to easy flow of a viscous liquid and if any sort of actual pump is used to urge the liquid through the dip tube, such pump is even more likely to have its operations impeded by the viscous liquid, particularly as such liquid ages.

The Appleby et al. U.S. Pat. No. 5,037,005, listed above with respect to bottom mounted openings in particular, discloses a bottle having a tapered shape with an opening or valve located adjacent the bottom near one corner of the smaller end. Appleby et al. discloses the advantage of maintaining the contents of a container always at the bottom of a dispenser against a dispensing valve in a squeezable container with the internal walls generally inclined toward the area of the container having the valve in it. However, while the Appleby et al. arrangement has certain advantages, it has not become popular, in part because of its relatively complicated structure and the likelihood of leakage due to the type of valve used which combines the function of an outlet for viscous liquid and an inlet for air to take the place of such liquid.

There has been a need, therefore, for a dispensing container for relatively viscous liquids that will readily and easily dispense such liquids upon demand, is leak proof between uses and is easy and convenient to use and has the entire interior of the container available for containment of liquid.

OBJECTS OF THE INVENTION

It is an object of the present invention therefore to provide a bottle or dispensing container having a dispensing valve near a lower edge toward which the walls of the entire container are generally slanted while having the entire interior of the container available for containment of a viscous liquid such as, for example, shampoo.

It is a further object of the invention to provide a bottle of a generally tapered design having the small end upwardly and having an air inlet at the top with a liquid valve positioned at a lower corner.

It is a still further object of the invention to provide an easily held bottle with a tight cap covering an inlet for air positioned above the surface of liquid within the bottle and a valve in the bottom adjacent one corner below the liquid level at all times for dispensing the liquid.

It is a still further object of the present invention to provide an easily held bottle which is readily produced by mold-type blow molding and having a liquid valve at one lower corner and an air valve at an upper corner.

It is a still further object of the invention to provide a bottle or container formed of an elongated generally equilateral pyramid having valves in apexes of said pyramid.

It is a still further object of the invention to provide a bottle or dispenser having an attractive easily grasped surface comprising the exterior of a generally upwardly elongated pyramid with a removable cap over an air inlet at an upper apex and a liquid valve in a lower apex.

It is a still further object of the invention to provide an easily produced efficient and convenient dispenser for shampoo and the like with a bottom dispensing valve from which fluid material may be dispensed easily merely upon opening said valve plus an easily operated air inlet valve.

It is a still further object of the invention to provide a pyramidal shaped bottle having three lateral upwardly elongated sides with an air inlet valve positioned at an upper apex and a liquid dispensing valve at a lower apex.

It is a still further object of the invention to provide a pyramidal shaped bottle-type dispenser having a generally truncated top with an air valve in such top and a dispensing valve in a bottom apex.

It is a still further object of the invention to provide a bottle-type dispenser having a pyramidal shape with a generally truncated top with an air-valve in the top having an operating handle in a shape to fill in the truncation with a continuation of the pyramid which preferably also has a truncated top.

It is a still further object of the invention to provide an elongated container having a major axis and a minor axis with said minor axis at an angle with respect to the major axis. The container being adapted for upright support during non-use and having an air inlet valve located adjacent the upper end and a liquid dispensing valve located adjacent the lower outer end of the minor axis.

SUMMARY OF THE INVENTION

An easy dispensing container for viscous liquids has a vertically elongated shape preferably larger at the bottom for stability and with a liquid dispensing valve in one corner of the bottom. An air inlet valve is provided at the top preferably with a cap or handle integrated into the external shape of the container. Preferably the container takes the form of a pyramidal bottle having a dispensing valve positioned in one lower corner and an air inlet valve positioned in a truncated top corner with a handle positioned over the air inlet valve with a generally truncated shape matching that of the container. The container of the invention is particlarly useful for holding and dispensing shampoo in a shower or the like, but is also useful for other types of viscous liquid.

DESCRIPTION OF THE PREFERRED EMBODIMENTS

Figure 1:
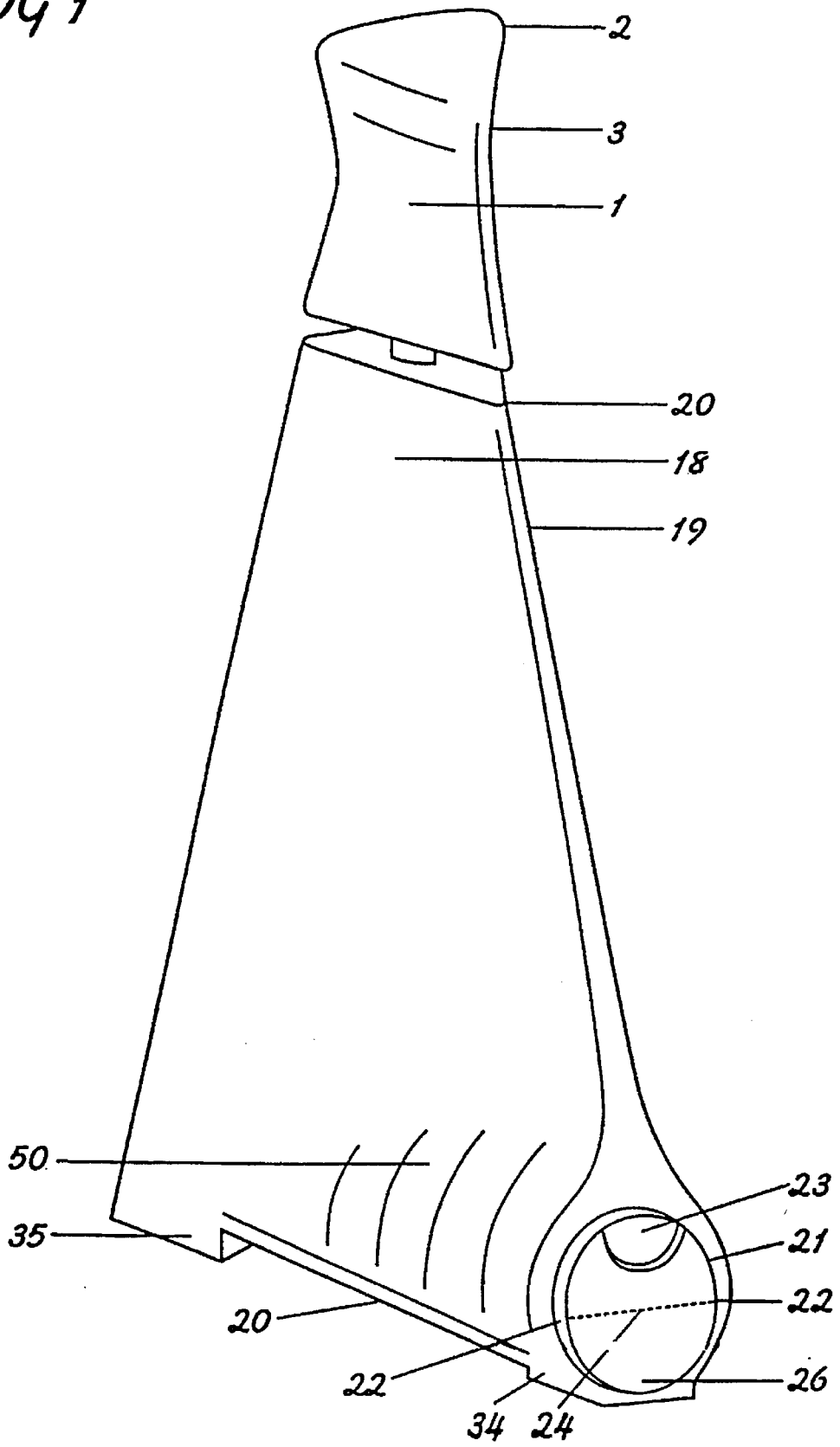
FIG. 1 is an isometric view of a dispensing container in accordance with the invention showing the air inlet cap in partially open position.

The present invention is directed to containers having an air inlet at the top and a bottom opening from which contained fluid material can be dispensed without having to invert or squeeze the container. The said container eliminates vacuum trapped fluid and permits easy flow of the fluid from the bottom opening with minimal waste of the fluid contents of the container.

The container of the invention is particularly useful for shampoos and other conditioners, but it can also be used for various other products which require the fluid contents of hand held containers to be distributed primarily, but not necessarily, into the hand of the user, such as, for example, suntan lotion and skin creams. The container can also be used for products such as mustard, ketchup and motor oil to name just a few.

Many types of fluid dispensing containers have been designed in the past. Some have been modified squeeze bottles, while others have been provided with varying types of air intake ducts to facilitate egress of the contents. Other containers have been designed with openings in the bottom to facilitate removal of the contents. The easy-to-use fluid dispensing container of the present invention, unlike most other containers, will allow the fluid contents to be smoothly and uninterruptedly dispensed with minimal waste because there is practically no remaining fluid left after nominal emptying of the container.

The preferred overall shape of the container of the invention is an elongated pyramid with a triangular bottom plane and three lateral sides. The bottom plane is preferably inclined from a tabletop plane upon which the container is supported or from actual horizontal if the bottle is supported in some other manner. The container's bottom plane may for this purpose be attached to three pedestal base feet, with two taller feet in the back of the container and one shorter foot positioned directly under the dispensing valve at the lowest point of the container's triangular base. The varying heights of the feet create the incline of the triangular base plane of the container. The preferred triangular shape of the container is easy for the user to grip when using. The edges of the triangular shaped container are rounded off so that they are not too sharp when the user grips the container creating the utmost in comfort to the hand of the user when dispensing shampoo or the like from the container. There is an air inlet cap at the top of the container which in a preferred embodiment may be pulled upward to allow air into the container, thus eliminating reduced pressure or vacuum inside the container. The cap is pressed down after using to reseal the container from entrance of air aiding in preventing unwanted leakage of liquid from the bottom.

The incline of the triangularly shaped base of the container allows the fluid contents of the container to be pulled or urged by gravity to the lowest point of the triangularly shaped base plane of the container where the dispensing valve is located. Because the fluid contents of the container are continually being urged by gravity towards the dispensing valve, the fluid contents of the container will always be adjacent to the dispensing valve of the container ready to flow from the container.

The bottom half of the preferred dispensing valve pushes beyond the edge of the bottle or emerges from the container when the top half of the dispensing valve is pressed inwardly into the container. When the rocking valve is oriented in open position, the fluid contents immediately begin to flow out of an opening in the bottom of the protruding bottom half of such dispensing valve. The fluid contents will flow smoothly into the users hand. With existing shampoo bottles, on the other hand, the usual bottle has to be turned upside down and sometimes squeezed to dispense the fluid contents. The user has to wait for the fluid contents to slowly flow toward the inverted top opening. In the applicant's preferred container, after the desired amount of the fluid contents has flowed into the users hand, the lower half of the dispensing valve is pressed back into the container, thus stopping the flow of the fluid contents from the container.

One substantial benefit of having a dispensing valve at the bottom of the container with the bottom plane of the container allowing the fluid contents to flow down an incline in the interior is that there is virtually no waste of any remaining fluid contents when the container is empty. Any fluid contents of the container will always be positioned at the dispensing valve as long as the container is in an upright orientation ready for use. During continual usage day after day, the fluid contents' level will slowly decline. When the container becomes empty, no more fluid will emerge or flow come out when the dispenser valve is pressed. There will be virtually no waste because all of the fluid contents will have been continuously available at the dispensing valve. Consequently, flow from the dispensing valve will cease only when there is no more fluid in the container. As a result, there is no waste of any fluid contents in the container.

The container of the invention has an air inlet cap positioned at the top of the container. The preferred air inlet cap, when pulled upward uncovers air inlet orifices or holes symmetrically encircling the sides of a flanged hollow cylinder protruding up from the main cavity of the container. Such air inlet holes when uncovered allow air to reenter the container which in turn eliminates any vacuum trapped fluid contents in the container. When the dispensing valve, located at the bottom of the container, is pressed, the fluid contents will flow out of the bottom orifice of the dispensing valve smoothly and uninterrupted into the hand of the user, while the top air inlet cap is held snugly on the top of the protruding hollow cylinder of the container. Such protruding cylinder is slightly flanged at the topmost rim to allow for a snug fit with the covering cap. The top air inlet cap is slid upward on the protruding top flanged cylinder to allow air back into the container. The air inlet cap is then pressed down after use. The top air inlet cap can be removed with minimal effort allowing for refilling of the container, if desired, through the top mouth of the protruding hollow flange cylinder. The fluid contents will be distributed into the container to the same refilling point during manufacturing and refilling. Because the top protruding cylinder of the container is flanged, it prevents the top air inlet cap from coming off too easily when it is pulled upward to allow air into the container when needed.

Broadly, the present invention provides a container, the fluid contents of which are dispensed through a dispensing valve located at the bottom of the container.

Air reenters the container via an air inlet located at the top of the container as fluid contents are dispensed from the bottom. This avoids vacuum trapping of fluid contents. The air inlet cap at the top of the container, when pulled upward (as needed) allows air back into the container to replace the volume of the fluid which flows from the container. The ability to close the air inlet valve at the top also provides a secondary means for preventing liquid from leaking through the dispensing valve at the bottom when such valve is closed, since any such liquid leakage tends to decrease air pressure in the container allowing external air pressure to aid in preventing leakage of liquid from the container dispensing valve.

Figure 2:
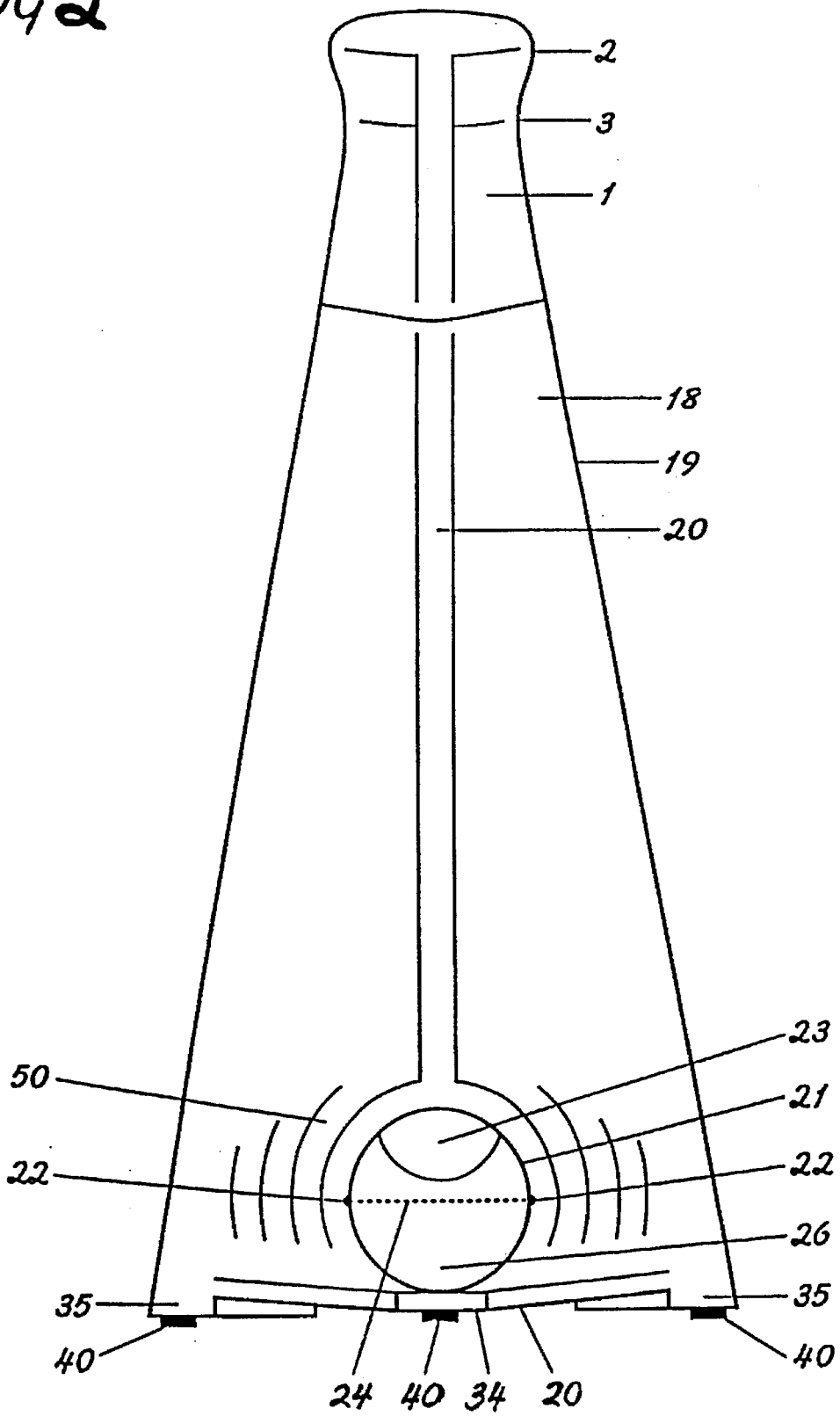
FIG. 2 is a front view of the container of the invention facing the dispensing valve with the air inlet cap in closed position.
Figure 3:
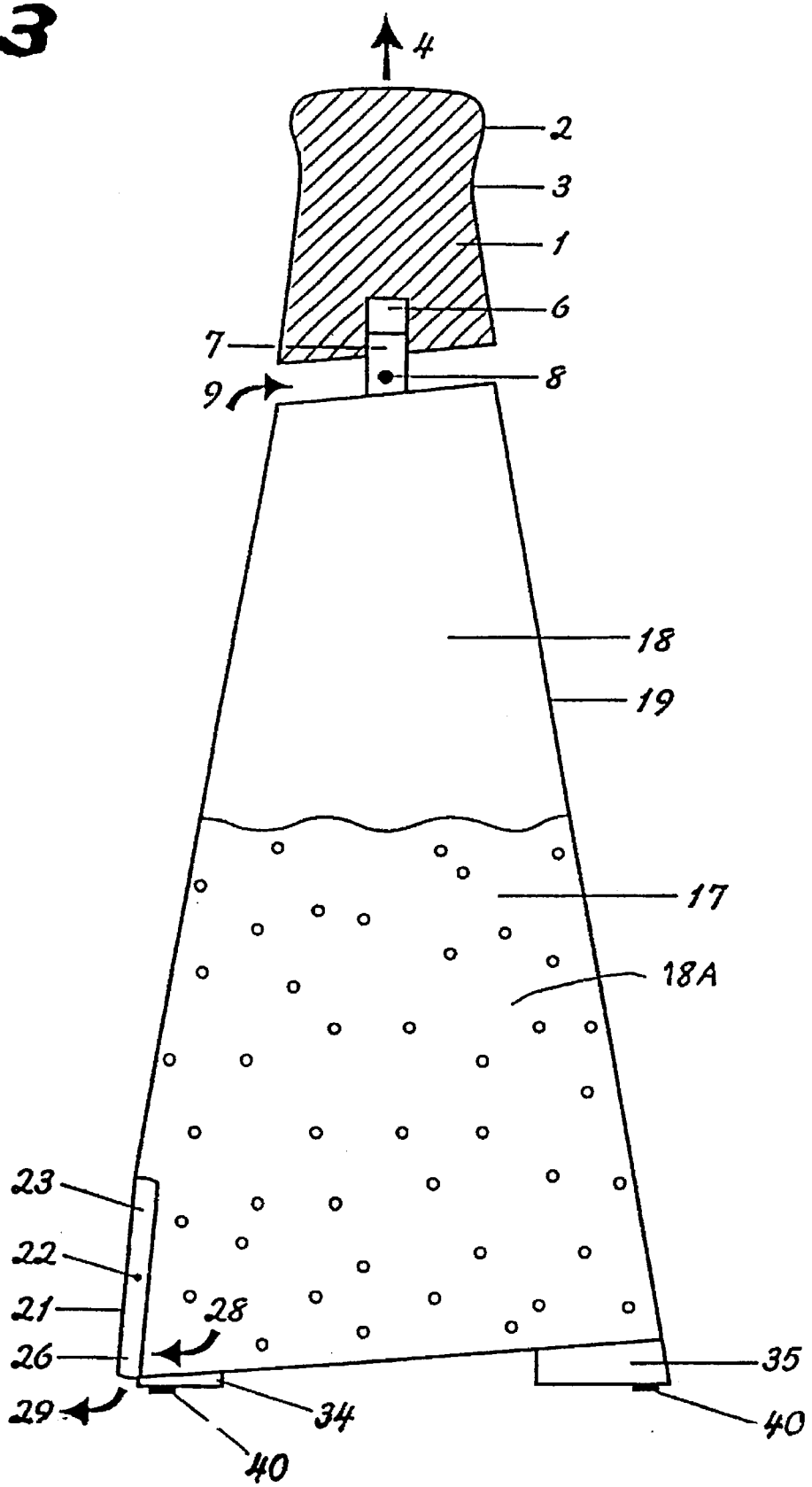
FIG. 3 is a partially sectioned and broken away or transparent view of one side of the container showing a portion of the fluid contents with the air inlet cap moved upwardly to allow air into the container's body cavity.

Before discussing the actual process of using this container, it will be desirable to first describe the working function of the air inlet cap. Turning to the drawings, in FIG. 1 and FIG. 2, it will be seen that the air inlet cap 1 is located at the top of the container. This air inlet cap may be gripped by the user between the thumb and index finger at a concave point 3 along the side planes of the air inlet cap and pulled upward in the direction 4 indicated in FIG. 3. The user's fingers will not slip off the air inlet cap 1 when pulling it upward due to the bowing out of the top 2 of the top air inlet cap 1 of the container. The top air inlet cap 1 includes a cylindrical hollowed out section 6. The air inlet cap 1 is shown in FIG. 3 as well as FIG. 4 in cross section by hatching to illustrate the solid area of such air inlet cap. A hollowed out cylindrical opening 6 of the air inlet cap 1 fits over a protruding flanged, hollow cylinder atop and connected to the main body cavity of the container. The top rim 15 of the protruding cylinder 7 is flanged out slightly as shown in FIG. 4 so that such flange fits snugly against the inside of the hollowed out cylindrical orifice 6 of the air inlet cap 1.

In FIG. 3, the top air inlet cap 1 is shown being pulled upward in the direction of the arrow 4 so that the air can enter at the opening 9 between the main body cavity of the container 18 via air inlet holes 8 disposed along the side of the protruding hollow cylinder 7 leading to the main body cavity 18A of the container. After the user has completed dispensing the desired amount of fluid contents from the container, the top air inlet cap 1 will be pressed back down so that the bottom 13 of the air inlet cap will rest directly on the top plane 14 of the container 18 (see FIGS. 2 and 4).

Figure 4:
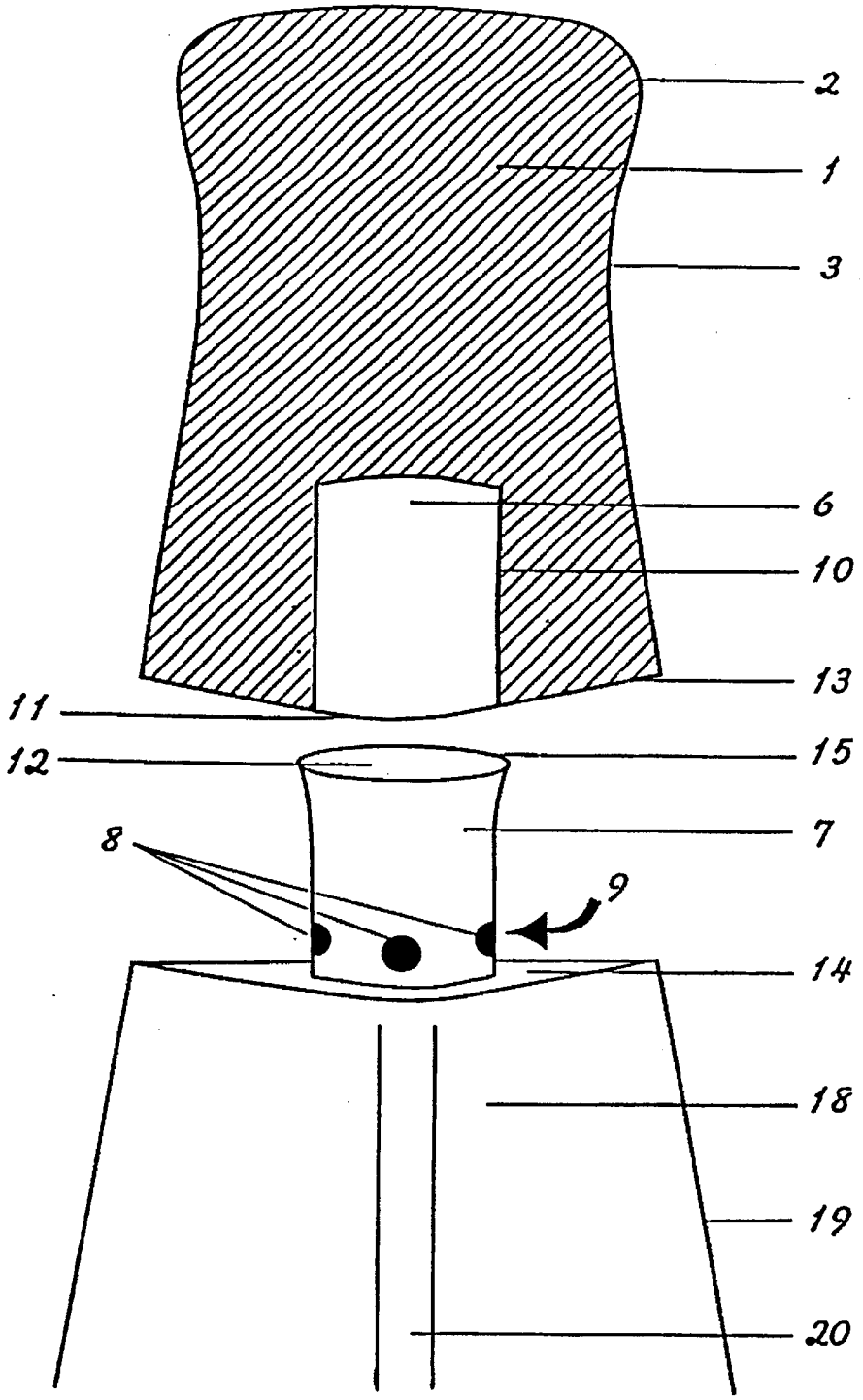
FIG. 4 is a partially sectioned detail of the top cap and protruding flanged cylinder with side air inlet holes of the inlet valve.

In FIG. 4, the top air inlet cap 1 is shown completely removed from the container. The opening 12 of the top open flanged protruding hollow cylinder 7 leads directly to the main body cavity 18A of the container 18. The fluid contents of the container will be filled during manufacture with the air inlet cap 1 removed as shown. Subsequently this is also the point where the fluid contents can be renewed or refilled by the consumer, if so desired.

Figure 7:
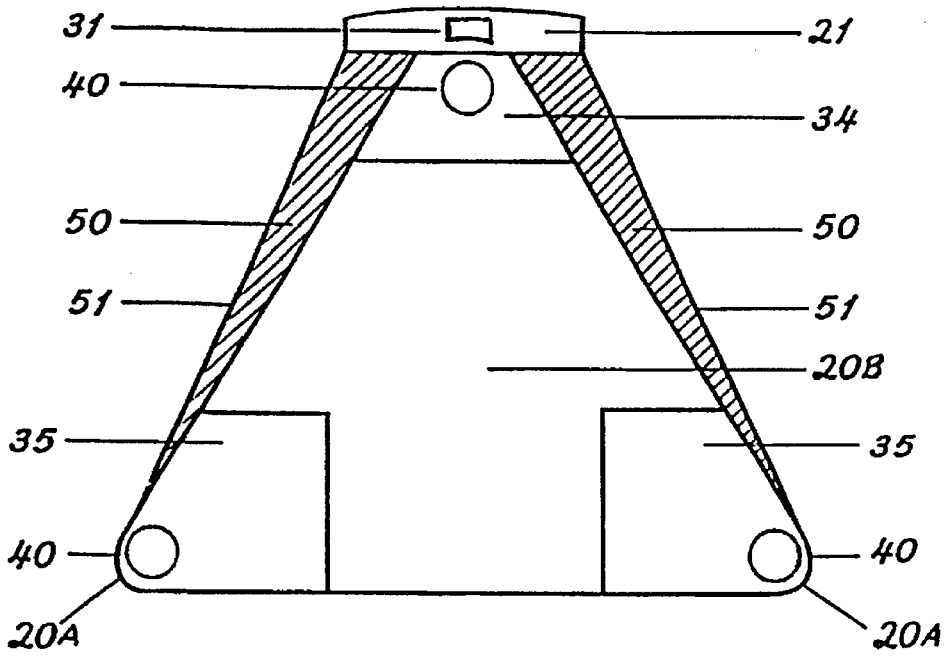
FIG. 7 is a bottom view of the container illustrating the shape of the base feet and the positioning of rubber buttons upon such feet as well as showing the dispensing valve in the position shown in FIG. 6.

Returning to FIG. 1, in which the container is not represented as transparent, it will be seen that the main body 18 of the container preferably takes the form of a pyramid with a triangular base. Two of the container's side planes bow out as shown at 50 from the walls of the container near the bottom to accommodate a dispensing valve 21 positioned in the center of one of the three edges 20 of the triangularly shaped base of the container. See also FIG. 2. The hatching in FIG. 7 illustrates this bowing out 50 of the side panels 51 in a bottom view of the container of the invention. Also shown in FIG. 7 are rounded edges 20A of the triangular shaped base 20B of the pyramidal container 18.

In FIG. 3 the bottom plane of the container is shown to rest on three pedestal base feet 34 and 35. The front base foot 34 located directly under the dispensing valve 21 is slightly shorter than the two back feet 35. This creates the incline of the base plane. FIG. 7 illustrates the shape and location of these base pedestal feet in relation to the dispensing valve 21.

Figure 5:
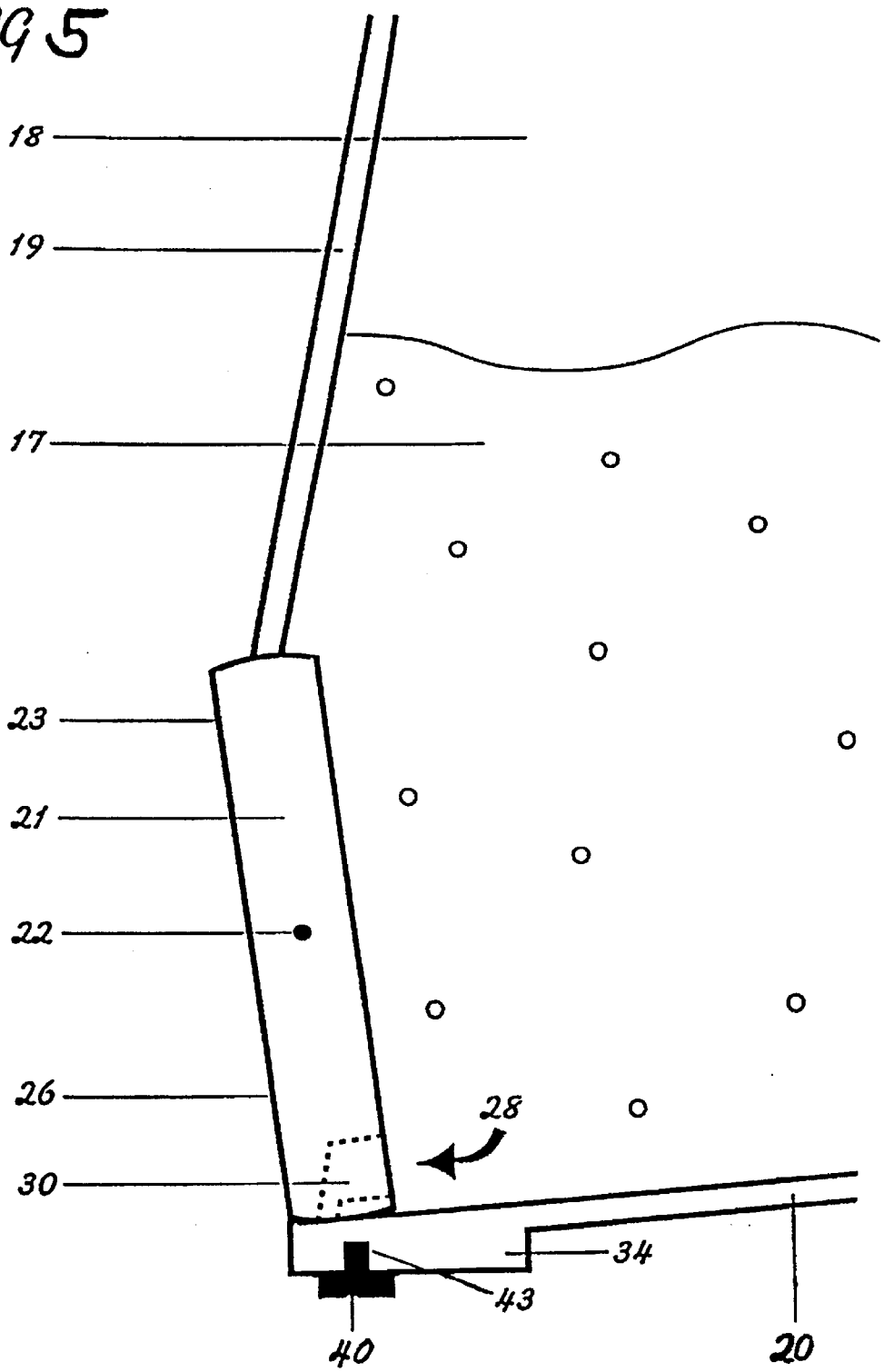
FIG. 5 is a detail cross-sectional view of the bottom portion of the container with the dispensing valve in closed position.
Figure 6:
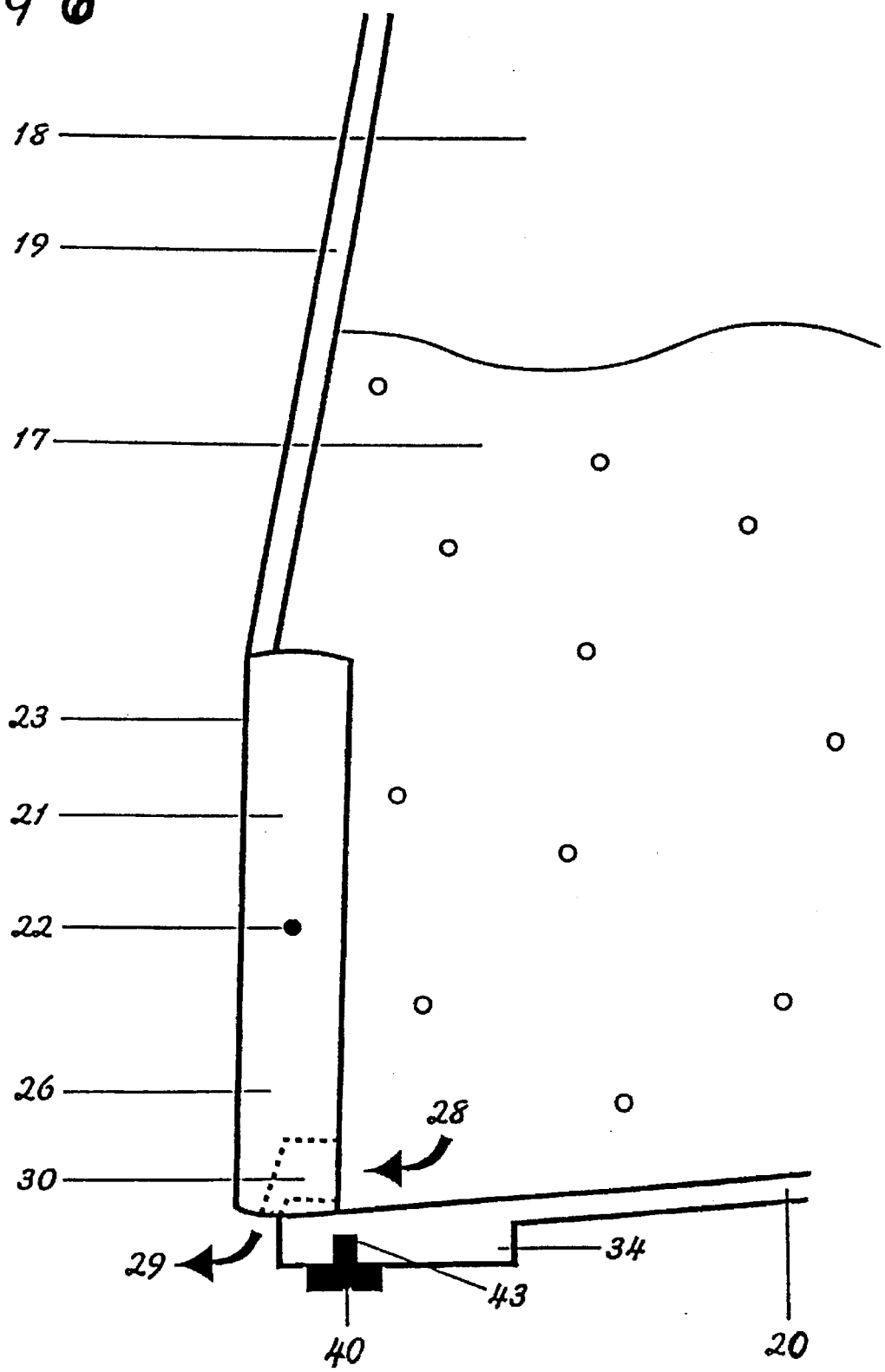
FIG. 6 is a detail cross-sectional view of the bottom portion of the container with the dispensing valve open and illustrating when taken together with FIG. 5 the operation of the valve and its relationship with the included bottom plane of the container.

In FIG. 3 the container 18 is illustrated either as partially cut away or transparent to show the fluid contents 17 inside. FIG. 5 and FIG. 6 are more detailed illustrations of the fluid dispensing process showing the operating positions of the dispensing valve 21. Before dispensing the fluid contents within the container, the air inlet cap 1 at the top of the container 18 will be first pulled upward as indicated at 4 allowing air to enter the container as previously described. In FIG. 4 the container is initially shown with the dispensing valve 21 closed. The dispensing valve pivots along an axis 24, as shown in FIGS. 1 and 2, on two small hemispheres 22 protruding from opposite sides of the round dispensing valve. These two protruding hemispheres 22 on the dispensing valve are inserted into concave hemispherical openings along the inside rim of the cylindrical opening housing the dispensing valve. This establishes the pivoting axis about which the dispensing valve 21 is opened and closed. The edges of the cylindrical opening housing the dispensing valve and the edges of the valve itself preferably have arcuate matching surface configurations to provide a tight liquid restraining interface or interfit as the value is rotated or rocked in order to minimize leakage through the valve. Returning to FIG. 5 the fluid contents 17 of the closed container are constantly being urged by gravity in the general direction of arrow 28 in FIGS. 5 and 6 along the inlined bottom plane 20 of the container towards the dispensing chamber 30 in the dispensing valve 21 of the container.

Referring now to FIG. 6, the top half 23 of the dispensing valve 21 has been pressed into the container, while pivoting along the center axis 24. This forces the bottom half 26 of the dispensing valve to protrude out from the bottom of the container, thus exposing the exit point or orifice 31, shown in FIG. 7, leading from the dispensing chamber 30 of the dispensing valve 21. In FIG. 6 the dispensing valve 21 is shown in opened position. The fluid contents 17 of the container are generally urged by gravity indicated by the arrow 28 along the bottom inclined base 20 of the container through the dispensing chamber 30 in the rotating valve 30 and exiting from the bottom half 26 of the dispensing valve 21 through orifice 31. When the desired amount of fluid contents have been extracted from the container, the bottom portion 26 of the dispensing valve 21 is pressed back into the container, stopping the flow of the fluid contents. After this step the air inlet cap 1 at the top of the container will be pressed back down to stop the air from entering the container as discussed earlier. The top air inlet cap 1 is also pressed back down to prevent evaporation of the fluid contents of the container.

Figure 8:
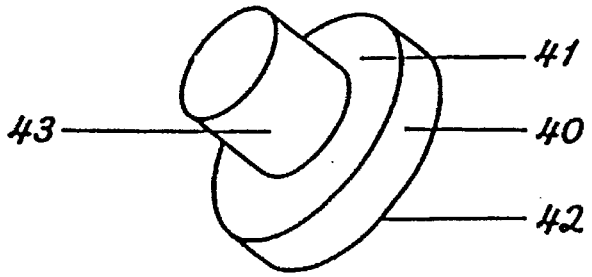
FIG. 8 is an enlarged isometric detail of one of the rubber buttons shown upon the base pedestal feet in FIGS. 2, 3, 5, 6 and 7.

Returning now to FIGS. 1 and 2 it will be seen that three small rubber buttons 40, the use of which is optional, are set into the bottom of the three pedestal feet 34 and 35. These rubber buttons prevent the container from slipping along any surface on which the container rests when it is being used in a wet environment (i.e. in a shower or the like). FIG. 7 shows the positioning of these rubber buttons with respect to the edges of the container. FIG. 8 shows in detail one of the three identical rubber buttons detached from the container. FIG. 5 and FIG. 6 show how the rubber buttons 40 are inserted into the pedestal feet 34 and 35. Referring to FIG. 8 the narrow cylinder 43 of the rubber button feet will be inserted into an accommodating hollowed out cylindrical openings or orifices in the bottom of the container's pedestal feet so that the top surface 41 of the rubber button will set flush against the bottom surface of the pedestal feet. The bottom of the rubber buttons 42 will then rest upon the tabletop plane or other supporting surface on which the container will rest.

When using the container of the invention, it will normally be supported upon a shelf or the like or, in some cases, suspended in an upright position. The bottom is preferably slanted toward the dispensing valve and the shape of the bottle itself is preferably in the form of an elongated truncated pyramid or truncated cone so that the bulk of the contents is collected near to the bottom adjacent to the dispensing valve. The user after first picking up the bottle will open the air inlet valve at the top, preferably by pulling on the handle attached to such valve. This releases air into the bottle and releases any vacuum lock upon the contents. Usually the top valve will be released by the fingers of one hand while the bottle is grasped in the other hand. However, the top can also be opened with the teeth or in most cases a single hand can be used to open the top while the bottle still rests on a shelf. After the top air inlet valve is opened, the bottom dispensing valve may be opened to allow the viscous fluid to flow from the bottle into the hand of the user or other receptacle. The flow from the dispensing valve is immediate, since the liquid contents of the bottle are always immediately against the valve unless all the liquid contents have been expended.

While the container or bottle of the invention has been shown and especially described in connection with a preferred form of such bottle, i.e. one in the shape of an elongated truncated pyramid and particularly a three sided or triangular shaped truncated pyramid, it will be understood that the invention could take several other forms including the use of different valves, both with respect to the liquid dispensing valve and the air inlet valve and also with respect to the shape of the bottle. For example, the bottle could be either in the form of a three or four sided pyramid, in the form of a truncated cone or even an elongated cylinder or in some cases an elongated oval or rectangle. The use of a three sided pyramid has, however, been found to be particularly effective, because, since the bottom of the bottle is preferably slanted toward the dispensing valve, it is advantageous to have the corner of the base in which the valve is disposed have as wide a feed angle for liquid flowing toward such valve as possible. A triangle is the widest angle symmetrical plane closed structure that can be constructed and the use, therefore, of a triangular shaped arrangement provides the maximum space utilization in close proximity to the valve, except for the use of a cone or cylinder, where the position of the dispensing valve along the bottom edge of such cone or cylinder structure at any point on the perimeter may be considered to be the use of the valve at a corner, such corner having the maximum space utilization adjacent to the valve possible in any regular geometrical structure.

The rocking type push dispensing valve illustrated in the drawings is also a very effective valve to use with the invention, since the large rounded contacting surfaces are effective to create an effective seal for viscous liquids and the air inlet valve very effectively inhibits leakage through the valve. Likewise, the illustrated push pull air inlet valve is particularly effective when used with the dispensing valve to provide one of the best and most effective combinations of valves for use in the dispensing container of the present invention. However, it will be understood that other types of valves may also be used.

In addition, while the present invention of a quick flow bottle has been described and illustrated with respect to a preferred container adapted to rest upon a horizontal surface, it may also be designed essentially to be vertically suspended from an upper support in a generally vertical orientation with the bottom inside surface preferably slanted toward the side of the container where the liquid dispensing valve is positioned and with the air inlet valve positioned at the top. The container may also be designed to be alternatively supported upon a horizontal surface or suspended from a support in a vertical position.

Broadly, the invention can be described as an elongated container arranged and constructed to be positioned during non-use, or between uses, with its major axis disposed in a vertical orientation and having an air-inlet valve at the top and a liquid dispensing valve at one corner of the bottom with preferably the internal surface of the bottom generally at least slightly inclined along a minor axis toward the liquid dispensing valve with the angles of the side walls adjacent to the valve being close to as wide as possible to maximize the collection of liquid in the vicinity of the valve. The valve should be hand operable and the surface of the container easily graspable.

While the present invention has been described at some length and with some particularity with respect to a preferred embodiment, it is not intended that it should be limited only to such particulars or embodiment or any particular embodiment, but is to be construed broadly with reference to the appended claims so as to provide the broadest possible interpretation of such claims in view of the prior art and, therefore, to effectively encompass the intended scope of the invention.

I claim:

1. A dispensing container for viscous liquids comprising:

(a) an elongated container having an upper and lower end and exterior surface tapered toward the upper end, (b) said elongated container having internal surfaces tapered toward the upper end and toward a plurality of corners at a lower and, (c) a hand manipulatable air inlet valve at the upper end, (d) a hand manipulatable liquid dispensing valve disposed at one of said corners of the lower end of said elongated container in a position such that the valve is internally contacted by any body of liquid within the container while said container is disposed in an upright position, said valve being operable by finger contact while grasping the container, (e) the exterior of such container being angular in outline and having an exterior outline of an elongated pyramid truncated at the top and graspable by the hand of a user, and (f) wherein the exterior of the air inlet valve comprises a second smaller pyramid filling in the truncated section of the elongated pyramid.

2. A dispensing container in accordance with claim 1 wherein the interior surface of the lower end of the container is slanted toward the liquid dispensing valve.

3. A dispensing container in accordance with claim 2 wherein the container has exterior supporting buttons on the bottom, one of which buttons is shorter than the others such that the interior surface of the container is slanted toward the liquid dispensing valve.

4. A dispensing container in accordance with claim 1 wherein the second small pyramid includes finger gripping means on its surface.

5. A dispensing container in accordance with claim 4 wherein the finger griping means comprises an expanded upper portion on the small pyramid.

6. A dispensing container comprising:

(a) a container having a greater vertical exterior dimension than transverse exterior dimensions with an inside bottom surface of said container positioned at an angle with respect to the exterior transverse dimensions, (b) the container having a plurality of triangular walls arranged to provide a pyramidal outer and inner construction, (c) a liquid dispensing valve positioned in the lower portion of the pyramidal construction adjacent to the lowest position of the inside bottom surface and connected with the interior of said construction, (d) an air inlet valve disposed in the top of the container, (e) wherein the pyramidal construction is a truncated three-sided pyramid and the air inlet valve is disposed at the top of the truncation, and (f) wherein the air inlet valve is provided with a finger contact portion in the form of a small pyramid substantially filling in the truncation of the main pyramid.

7. A dispensing container in accordance with claim 6 wherein the small pyramid is also truncated and has an outwardly expanded upper portion.

8. A dispensing container for viscous liquids comprising:

(a) an elongated container for upright support and having an exterior surface tapering toward an upper end, (b) said elongated container having internal walls generally slanted toward an upper end, (c) a hand manipulatable air inlet valve at the upper end, (d) a hand manipulatable liquid dispensing valve disposed at the intersection of the exterior surface of said elongated container and a bottom surface of the container in a position such that the valve is internally contacted by any body of liquid within the container while said container is disposed in its normal upright position, said valve being operable by finger contact while grasping the container, and (f) wherein the exterior of the container is an elongated pyramid truncated at the top and the handle of the air inlet valve comprises a small pyramid filling in the truncated section of the main pyramid.

9. A dispensing container in accordance with claim 8 wherein the interior of the lower end of the container is slanted toward the liquid dispensing valve.

10. A dispensing container in accordance with claim 9 wherein the container has exterior bottom supporting buttons, lone of which is shorter than the others such that the bottom of the container is slanted toward the liquid valve.

11. A dispensing container in accordance with claim 8 wherein the small pyramid includes finger gripping means on its surface.

12. A dispensing container in accordance with claim 11 wherein the finger griping means comprises an expanded top on the small pyramid.

13. A quick dispensing container in accordance with claim 8 wherein the exterior of such container is angular in outline and the air inlet valve comprises a cylindrical extension connected with the interior of the container, having at least one opening in the lateral surface and over which the small pyramid extends in a closed position occluding said orifice when brought against the top of the large pyramid and opening said orifice when the small pyramid is raised from contact with the top of the large pyramid.

14. A dispensing container in accordance with claim 13 wherein there are a plurality of orifices in the cylindrical extension which are occluded by the small pyramid.

15. A dispensing container in accordance with claim 14 wherein the cylindrical extension has a tight fitting flange on the top arranged and constructed to have a tight fit with a cylindrical orifice in the lower end of the small pyramid.

16. A dispensing container comprising:

(a) a container adapted for support on a horizontal surface with the inside bottom surface of said container positioned at an angle with said horizontal surface, (b) the container having a plurality of triangular walls arranged to provide a pyramidal outer construction, (c) a liquid dispensing valve positioned in a lower portion of the pyramidal construction adjacent to a lowest portion of the inside bottom surface and connected with the interior of said construction, (d) an air inlet valve disposed in the top of the container.

(e) wherein the pyramidal construction is a truncated pyramid and the air inlet valve is disposed at the top of the truncation, (f) wherein the pyramidal construction is that of a three-sided pyramid and (g) wherein the air inlet valve is provided with a finger contact portion in the form of a small pyramid substantially filling in the truncation of the main pyramid.

17. A dispensing container in accordance with claim 16 wherein the small pyramid is truncated and has an expanded upper portion for effective gripping by human fingers.

18. A dispensing container for viscous liquids comprising:

(a) an elongated container having an upper and lower end and exterior surface tapered toward the upper end, (b) said elongated container having internal surfaces tapered toward the upper end and toward a plurality of corners at a lower end, (c) a hand manipulatable air inlet valve at the upper end, (d) a hand manipulatable liquid dispensing valve disposed at one of said corners of the lower end of said elongated container in a position such that the valve is internally contacted by any body of liquid within the container while said container is disposed in an upright position, said valve being operable by finger contact while grasping the container, (e) wherein the exterior of such container is angular in outline and such outline of the exterior of the container is an elongated pyramid adapted for grasping by the hand of the user, and (f) wherein the liquid dispensing valve is disposed in a rounded interior expansion of one of the corners of the lower end of the elongated pyramid.

19. A dispensing container in accordance with claim 18 wherein the liquid dispensing valve is a finger operated rocking-type valve.

20. A dispensing container for viscous liquids comprising:

(a) an elongated container having an upper and lower end and an exterior surface tapered toward the upper end, (b) said elongated container having an internal surface tapered toward the upper end and toward a plurality of corners at a lower end, (c) a hand manipulatable air inlet valve at the upper end, (d) a hand manipulatable liquid dispensing valve disposed at one of said corners of the lower end of said elongated container in a position such that the valve is internally contacted by any body of liquid within the container while said container is disposed in an upright position, said valve being operable by finger contact while grasping the container, (e) wherein the exterior of such container is angular in outline and (f) wherein the air inlet valve comprises a cylindrical extension connected with the interior of the container, having at least one opening in said extension and over which a small pyramid extends in a closed position occluding said opening when brought against the top of the elongated container configured as a larger pyramid and removing any occlusion of said opening when the small pyramid is raised from contact with the top of the larger pyramid.

21. A dispensing container in accordance with claim 20 wherein there are a plurality of side openings in the cylindrical extension which are occluded by the smaller pyramid.

22. A dispensing container in accordance with claim 21 wherein the cylindrical extension has a tight fitting flange on the top arranged and constructed to have a tight fit with a cylindrical orifice in the lower end of the smaller pyramid.

* * * * *